US006906706B2

(12) United States Patent
Kosaka et al.

(10) Patent No.: US 6,906,706 B2
(45) Date of Patent: Jun. 14, 2005

(54) DRIVING METHOD OF DISPLAY PANEL AND DISPLAY DEVICE

(75) Inventors: Tadayoshi Kosaka, Kawasaki (JP); Kenji Awamoto, Kawasaki (JP); Fumihiro Namiki, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 577 days.

(21) Appl. No.: 09/875,284

(22) Filed: Jun. 7, 2001

(65) Prior Publication Data

US 2002/0005844 A1 Jan. 17, 2002

Related U.S. Application Data

(63) Continuation of application No. PCT/JP99/06831, filed on Dec. 6, 1999.

(30) Foreign Application Priority Data

Dec. 8, 1998 (JP) ..... 10-347690

(51) Int. Cl.[7] ..... G09G 5/00; G09G 3/28; G09G 3/30

(52) U.S. Cl. ..... 345/211; 345/87; 345/82; 345/75.2; 345/76; 345/60; 315/169.1; 315/169.3; 315/169.4

(58) Field of Search ..... 345/76, 82, 87, 345/74.1, 75.2, 60–72, 211–213, 92, 98, 100, 204, 94; 315/169.1, 169.3, 169.4

(56) References Cited

U.S. PATENT DOCUMENTS 5,583,527 A * 12/1996 Fujisaki et al. ..... 345/55
6,172,659 B1 * 1/2001 Kim ..... 345/42
6,243,073 B1 * 6/2001 Kawamura et al. ..... 345/148
6,271,809 B1 * 8/2001 Kim ..... 345/60
6,333,738 B1 * 12/2001 Ide ..... 345/211
6,522,314 B1 * 2/2003 Tomio et al. ..... 345/68
6,559,816 B1 * 5/2003 Koo et al. ..... 345/60
6,614,411 B2 * 9/2003 Hayashi ..... 345/60

FOREIGN PATENT DOCUMENTS

| | | |
|---|---|---|
| EP | 0 837 443 | 4/1998 |
| JP | 8-30227 | 2/1996 |
| JP | 8-160901 | 6/1996 |
| JP | 8-320669 | 12/1996 |
| JP | 10-123998 | 5/1998 |
| JP | 10-187093 | 7/1998 |
| JP | 11-327507 | 11/1999 |
| JP | 11-338418 | 12/1999 |

* cited by examiner

*Primary Examiner*—Alexander Eisen
*Assistant Examiner*—Kimnhung Nguyen
(74) *Attorney, Agent, or Firm*—Staas & Halsey LLP

(57) ABSTRACT

Undue power consumption is reduced in the capacitance between data electrodes during addressing in a display panel. The power consumption associated with the capacitance is reduced to half as compared with the conventional panel, because the current associated with the discharge of the capacitance is independent of the power supply in the case of a combination of "L reset", where the capacitance between data electrodes is discharged through a backward current path on the current sink terminal side, and "H reset", where the capacitance between data electrodes is discharged through a backward current path on the current supply terminal side.

19 Claims, 21 Drawing Sheets

FIG. 1 FIRST PROCESS OF SWITCHING ELECTRODES (L RESET)

SECOND PROCESS OF SWITCHING ELECTRODES (H RESET)

TRUTH TABLE

| SUS | TSC | TSC' | $D_m$ | UP | DOWN |
|---|---|---|---|---|---|
| H | L | L | 0 | OFF | OFF |
| H | L | L | 1 | OFF | OFF |
| H | H | H | 0 | OFF | ON |
| H | H | H | 1 | ON | OFF |
| L | L | L | 0 | OFF | OFF |
| L | L | L | 1 | OFF | OFF |
| L | H | H | 0 | OFF | ON |
| L | H | H | 1 | OFF | ON |

| SUS | TSC | $D_m$ | UP | DOWN |
|---|---|---|---|---|
| H | L | 0 | OFF | OFF |
| H | L | 1 | OFF | OFF |
| H | H | 0 | OFF | ON |
| H | H | 1 | ON | OFF |
| L | L | 0 | OFF | OFF |
| L | L | 1 | OFF | OFF |
| L | H | 0 | OFF | ON |
| L | H | 1 | OFF | ON |

DISPLAY ELECTRODES OF PDP

DISPLAY ELECTRODES OF PALC

DISPLAY ELECTRODES OF LCD

DISPLAY ELECTRODES OF FED

DRIVING METHOD OF DISPLAY PANEL AND DISPLAY DEVICE

This application is a continuing application, filed under 35 U.S.C. §111(a), of International Application PCT/JP99/06831, filed Dec. 6, 1999, it being further noted that priority is based upon Japanese Patent Application 10-347690, filed Dec. 8, 1998.

FIELD OF THE INVENTION

The present invention relates to a driving method of a display panel such as a plasma display panel (PDP), a plasma addressed liquid crystal (PALC), a liquid crystal display (LCD) or a field emission display (FED), and to a thin type display device.

DESCRIPTION OF THE PRIOR ART

A display panel is used as a device replacing a CRT in various fields. For example, a PDP is commercialized as a wall-hung TV set having a large screen above 40 inches. One of challenges to high definition and a large screen is a countermeasure against capacitance between electrodes.

As shown in FIG. 16, a display panel comprises scan electrodes $S_1$, $S_2$, . . . , $S_N$ for row selection and data electrodes $A_1$, $A_2$, . . . , $A_M$ for column selection, which are arranged in a matrix. The suffix of the reference letter indicates an arrangement order of the electrode. A unit display area is defined at each of intersections of the scan electrodes $S_1$–$S_N$ and the data electrodes $A_1$–$A_M$, and a display element is disposed at each of the unit display area. FIG. 16 typically shows display elements of a first row and a second row in the (m+1)th column. As shown in FIGS. 17A to 17D using symbols, display elements of a PDP and a PALC are discharge cells. An LCD has liquid cells as the display elements, while an FED has field emitters as the display elements. Furthermore, a commercialized surface discharge type PDP has two electrodes arranged for each row, and only one of the two electrodes is used for the row selection. Therefore, the electrode structure of the surface discharge type PDP is considered as a simple matrix similar to that of other types from the viewpoint of the display element selection.

Contents of display are set by line sequential addressing as shown in FIG. 18. An address period TA of one frame is divided into row selection periods Ty whose number is the same as the number of lines N of the screen. Each of the scan electrodes $S_1$–$S_N$ is biased to a predetermined potential to be active in any one of the row selection periods Ty. Usually, the scan electrode is activated in order from an end of the arrangement in every row selection period. In synchronization with this row selection, display data of a row are outputted from data electrodes $A_1$–$A_M$ for each row selection period. Namely, potential of all data electrodes $A_1$–$A_M$ are controlled at the same time corresponding to the display data. The potential is controlled in a binary manner or in a multivalued manner for gradation display.

The binary control of the potential of the data electrodes $A_1$–$A_M$ utilizes a switching circuit having a push-pull structure according to an embodiment of the present invention as shown in FIG. 5. Only one switching element Q1, constituting a pair of switching elements Q1 and Q2, is turned on so as to connect the data electrode $A_m$ to a power supply terminal of a driving power source (a high potential terminal of a voltage output). Otherwise, only the other switching element Q2 is turned on so as to connect the data electrode $A_m$ to a current sink terminal of the driving power source (a ground terminal, in general). ON or OFF of each switching element Q1 or Q2 is determined by the display data $D_m$ of the corresponding column.

FIG. 20 is a time chart for controlling the data electrode in the conventional driving method.

It is supposed that a pair of switches SW1 and SW2 control the potential of the data electrode $A_m$. The switch SW1 corresponds to the above-mentioned switching element Q1, and the switch SW1 corresponds to the switching element Q2.

In a push-pull structure, it must be avoided that a pair of switches SW1 and SW2 are turned on at the same time, which causes a short circuit of the driving power source. Therefore, in order to prevent the short circuit securely when the row selection is switched under the condition where the display data $D_m$ are different between n-th ($1 \leqq n < N$) row selection and the next (n+1)th row selection, both the switches SW1 and SW2 are turned off between the row selection periods Ty. In other words, in the n-th row selection period Ty, when one of the switches SW1 and SW2 is turned on, the switch SW1 or the switch SW2 is turned on at the starting stage of the row selection period Ty and is turned off before the end point of the row selection period Ty. This operation is performed by controlling the switches SW1 and SW2 using the AND signal of the timing signal TSC turning on and off in the row selection period and the display data $D_m$ of the corresponding m-th column.

In the conventional method, the on and off timings of the switch SW1 are the same as those of the switch SW2 for the start point of the row selection period Ty. In addition, the on and off timings of the switching element is also the same between the neighboring data electrodes. The conventional driving method had a problem in that there was much loss of power for charging a capacitance between the neighboring data electrodes. Hereinafter, this problem will be explained in detail.

It is supposed that the addressing is performed in a pattern in which potential of the data electrodes are switched oppositely between the m-th column and the neighboring (m+1)th column as shown in FIG. 20, and the potential are switched in both columns every row selection period Ty. In this pattern, the display data $D_m$ of the m-th column and the display data $D_{m+}1$ of the (m+1)th column are set 0 or 1 alternately. The contents of the display are as shown in FIG. 19.

FIG. 21 shows the problem of the conventional method.

The problem is that when biasing the data electrode to the polarity opposite to the charge stored between the data electrodes, current canceling the charge must be supplied as being explained below.

[Step 1] At the time point just before the end of the row selection period Ty, the switches $SW1_m$ and $SW2_m$ of the m-th column and the switches $SW1_{m+1}$ and $SW2_{m+1}$ of the (m+1)th column are off (high impedance state). The capacitance between the data electrodes is charged so that the m-th column side has the positive polarity (+) and the (m+1)th column side has the negative polarity (−). The letters in the parentheses indicate potentials in FIG. 21.

[Step 2] At the time point when the switches $SW2_m$ and $SW1_{m+1}$ are turned on at the same time, the data electrode $A_m$ is connected to the ground, and the potential of the data electrode $A_{m+1}$ drops to −Va, so that current Ia canceling the charge stored in the capacitance between the data electrodes starts to flow from the power source passing through the switch $SW1_{m+1}$. This current Ia is accumulated as power consumption of the display panel. At the moment when the stored charge is cancelled (discharged) completely, the voltage between the data electrodes becomes zero volts.

[Step 3] Following the current Ia, new current Ib flows for charging the capacitance between the data electrodes to a polarity opposite to the previous polarity. This current Ib is also supplied by the power source and is accumulated as power consumption. The current Ia is equal to the current Ib in the principle.

As explained above, the conventional driving method consumes power for discharging and charging the capacitance between the data electrodes. Furthermore, there is a method for reducing the power consumption, in which a reset period is provided so that all the switches $SW2_m$ and $SW2_{m+1}$ of the current sink side are turned on. When the switches $SW2_m$ and $SW2_{m+1}$ are turned on, the data electrodes are connected via the ground side power source line, so that the stored charge is discharged. However, there are two problems in this method. One of the problems is that since a period for turning off all the switches $SW1_m$, $SW1_{m+1}$, $SW2_m$ and $SW2_{m+1}$ in the current supplying side and the current sink side is required in order to prevent the short circuit of the power source after the reset period, the row selection period Ty is elongated due to the period, resulting in drop of the display speed. The other problem is that the potential of the data electrodes $A_m$ and $A_{m+1}$ are switched every row selection period Ty even if the display data $D_m$ and $D_{m+1}$ are constant as in the case where a line in the column direction is drawn, thereby power is consumed for charging and discharging the capacitance between the data electrodes.

An object of the present invention is to reduce undesired power consumption due to the capacitance between the data electrodes.

SUMMARY OF THE INVENTION

In the display panel to which the present invention is applied, during the period satisfying setting conditions in addressing, one of neighboring data electrodes is connected to a power source terminal, and the data electrodes are connected to each other by a short circuit of a current path including a diode provided between the other data electrode and the power source terminal and a power source line, so that charge stored in capacitance between the data electrodes is discharged.

The principle of the present invention is shown in FIGS. 1 and 2. For the data electrode $A_m$ of the m-th column that is any noted column, backward current paths P1 and P2 are formed in parallel with each of switches $SW1_m$ and $SW2_m$ controlling the potential in binary manner. The backward current paths P1 and P2 are obtained by connecting diodes, or using switching elements having parasitic diodes as the switches $SW1_m$ and $SW2_m$. The backward means the direction in which the current supply terminal side (high potential side) of the power source is a cathode and the current sink terminal side (low potential side) is an anode. In the same way, for the data electrode $A_{m+1}$ of the (m+1)th column too, a switching circuit having backward current paths P1 and P2 is provided.

In the addressing to which the present invention is applied, in synchronization with the row selection the data electrode $A_m$ is switched from the bias potential (Va) to the ground potential (0), and oppositely the data electrode $A_{m+1}$ is switched from the ground potential (0) to the bias potential (Va). This switching control has a first process called "L reset" and a second process called "H reset".

The L reset includes a step of discharging the capacitance between the data electrodes using the backward current path P2 of the current sink terminal side (ground side) as shown in FIG. 1.

[Step 1] At the tie point just before the end of the row selection period Ty, the switches $SW1_m$ and $SW2_m$ of the m-th column and the switches $SW1_{m+1}$ and $SW2_{m+1}$ of the (m+1)th column are off (high impedance state). The capacitance between the data electrodes is charged in the manner that the m-th column side is the positive polarity (+), and the (m+1)th column side is the negative polarity (−).

[Step 2] When only the switch $SW2_m$ is turned on, the potential of the data electrode $A_{m+1}$ drops to −Va. As a result, current Ia flows from the ground line to the data electrode $A_{m+1}$ via the backward current path P2 that is parallel with the switch $SW2_{m+1}$. At the same time, the current Ia flows from the data electrode $A_m$ to the ground line via the switch $SW2_m$. Namely, the charge between the data electrodes is discharged by a closed loop including the ground line, and power source does not supply current.

[Step 3] The current Ia flows until the data electrode $A_{m+1}$ becomes the ground potential (0).

[Step 4] When the switch $SW1_{m+1}$ is turned on while the switch $SW2_m$ is turned off, current Ib charging the capacitance flows from the current supply line to the data electrode $A_{m+1}$ until the potential of the data electrode $A_{m+1}$ rises from the ground potential to the bias potential (Va).

In the L reset, though the current Ia and the current Ib flow in the same way as the conventional method, the current Ia related to the discharge of the capacitance does not depend on the current supply from the power source. Therefore, power consumption related to the capacitance is a half of the conventional method.

H reset includes a step of discharging the capacitance between the data electrodes using the backward current path P1 of the current supply terminal side as shown in FIG. 2.

[Step 1] The switches $SW1_m$, $SW2_m$, $SW1_{m+1}$ and $SW2_{m+1}$ are off (high impedance state). The capacitance between the data electrodes is charged in the manner that the m-th column side is positive (+), and the (m+1)th column side is negative (−).

[Step 2] When only the switch $SW1_{m+1}$ is turned on, the potential of the data electrode $A_m$ rises from Va to 2Va. As a result, the current Ia flows from the data electrode Am to the current supply line passing through the backward current path P1 that is parallel with the switch $SW1_m$. At the same time, the current Ia flows from the current supply line to the data electrode $A_{m+1}$ via the switch $SW2_m$. Namely, the charge between the data electrodes is discharged by a closed loop including the current supply line, and power source does not supply current.

[Step 3] The current Ia flows until the data electrode $A_{m+1}$ becomes the bias potential (Va).

[Step 4] When the switch $SW2_m$ is turned on while the switch $SW1_{m+1}$ is turned on, the current Ib charging the capacitance between the data electrodes flows until the potential of the data electrode $A_m$ drops to ground potential.

In the H reset, though the current Ia and the current Ib flow in the same way as the conventional method, the current Ia relating to the discharge of the capacitance does not depend on the current supply from the power source. Therefore, power consumption relating to the capacitance is a half of the conventional method.

The above-mentioned L reset and H reset are effective in the case where the switching of the display data in the neighboring data electrodes are opposite to each other as explained above. However, it is unnecessary for controlling the switches $SW1_m$, $SW2_m$, $SW1_{m+1}$ and $SW2_{m+1}$ to decide whether the display data are different between the n-th row and the (n+1)th row in each column, or whether the display data are different between the neighboring columns. The L reset and the H reset are realized by shifting the control timing between the switch SW1 and the switch SW2 for all columns, or by shifting the control timing of the switches SW1 and SW2 between the odd column and the even column.

DESCRIPTION OF THE PREFERRED EMBODIMENTS

Figure 1:
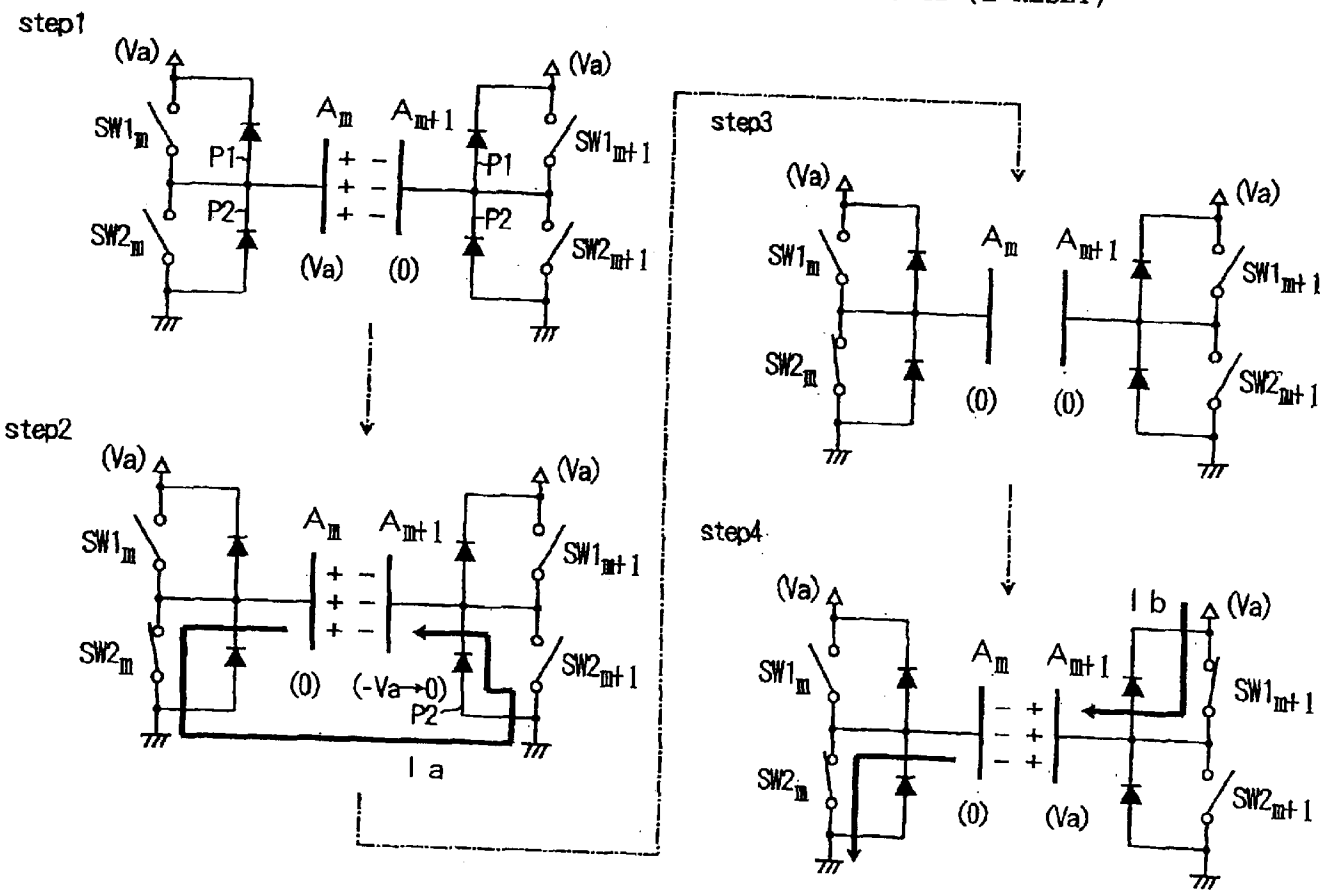
FIG. 1 is a diagram showing the principle of the present invention.
Figure 2:
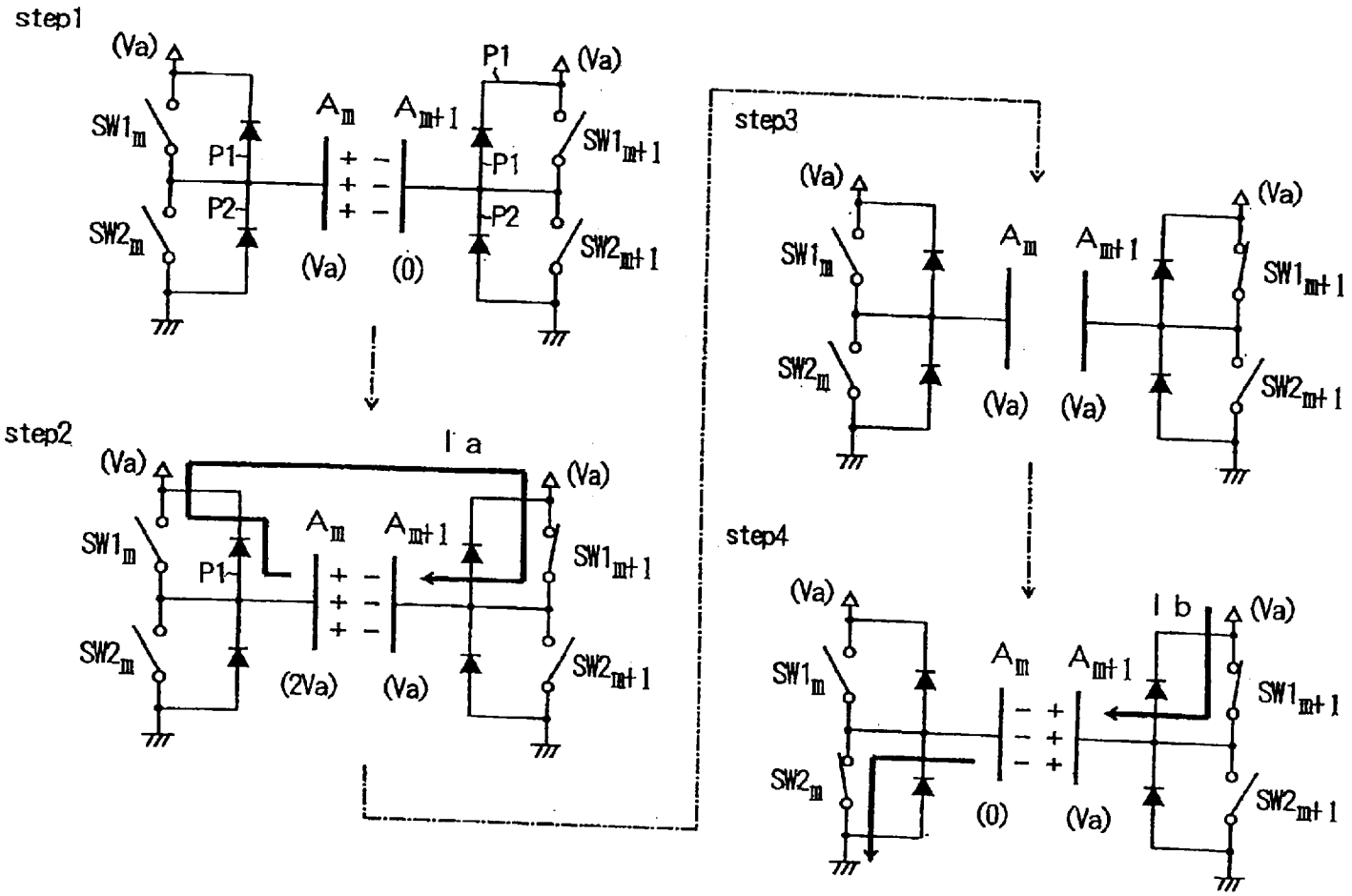
FIG. 2 is a diagram showing the principle of the present invention.
Figure 3:
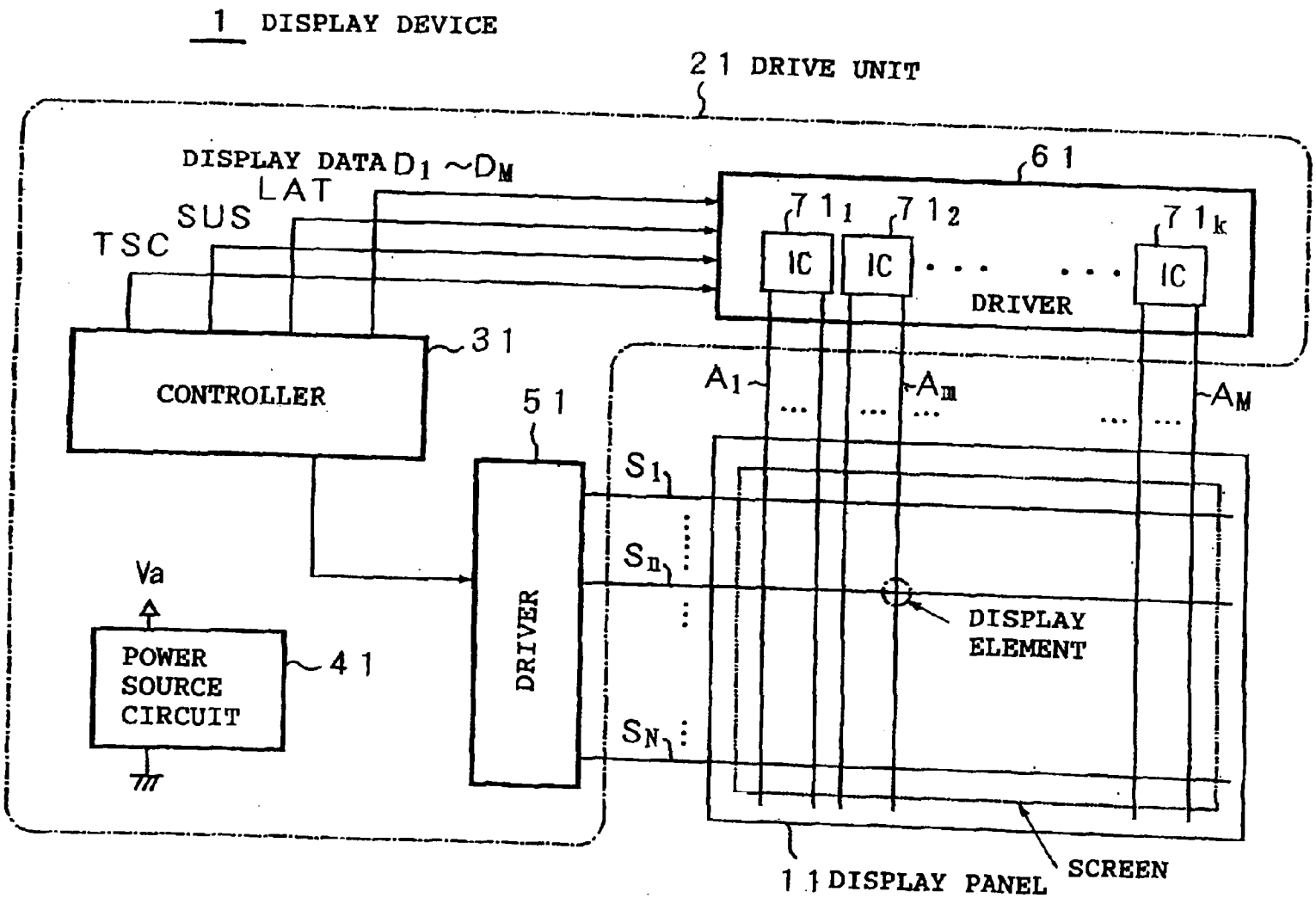
FIG. 3 is a block diagram of a main portion of a display device according to a first embodiment.

As shown in FIG. 3, a display device 1 comprises a display panel 11 having a screen including M×N display elements and a drive unit 21 for controlling potential of scan electrodes $S_1$–$S_N$ and data electrodes $A_1$–$A_M$. The drive unit 21 includes a controller 31, a power source circuit 41, a driver 51 of the scan electrodes $S_1$–$S_N$ and a driver 61 of the data electrodes $A_1$–$A_M$. The driver 61 includes a plurality of integrated circuit chips $\mathbf{71}_1$–$\mathbf{71}_k$ having the same structure being charged in controlling 256 data electrodes $A_1$–$A_M$, for example. The controller 31 transfers display data $D_1$–$D_M$ of M columns selected in each row selection period Ty of the addressing to the driver 61 serially and gives control signals LAT, SUS and TSC that will be explained later to the driver 61.

Figure 4:
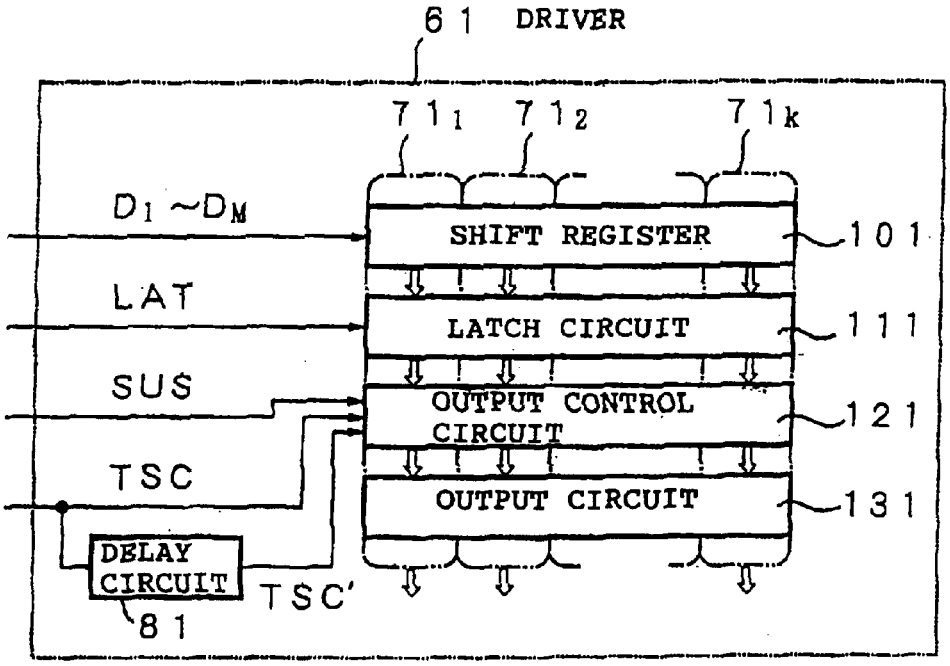
FIG. 4 is a functional block diagram of a driver according to the first embodiment.

As shown in FIG. 4, in the driver 61, a set of the integrated circuit chips $\mathbf{71}_1$–$\mathbf{71}_k$ constitute four functional blocks including a shift register 101, a latch circuit 111, an output control circuit 121 and an output circuit 131. The shift register 101 inputs display data $D_1$–$D_M$ serially and outputs the display data $D_1$–$D_M$ in parallel. The output control circuit 121 generates switching signals corresponding to combinations of the display data D1–DM latched in accordance with the signal LAT and control signals SUS, TSC and TSC'. The control signal SUS is a low-active signal for separating all data electrodes $A_1$–$A_M$ as a single unit from the high potential side terminal of the power source and is non-active continuously in the addressing. The timing signal TSC repeats on and off at the row selection period in the addressing, so as to prevent the power source from a short circuit. The timing signal TSC' is a control signal unique to the present invention and is a timing signal TSC that passed through the delay circuit 81. The output circuit 131 changes the connection state of the data electrodes $A_1$–$A_M$ with the power source circuit 41 in accordance with the switching signal from the output control circuit 121.

Figure 5:
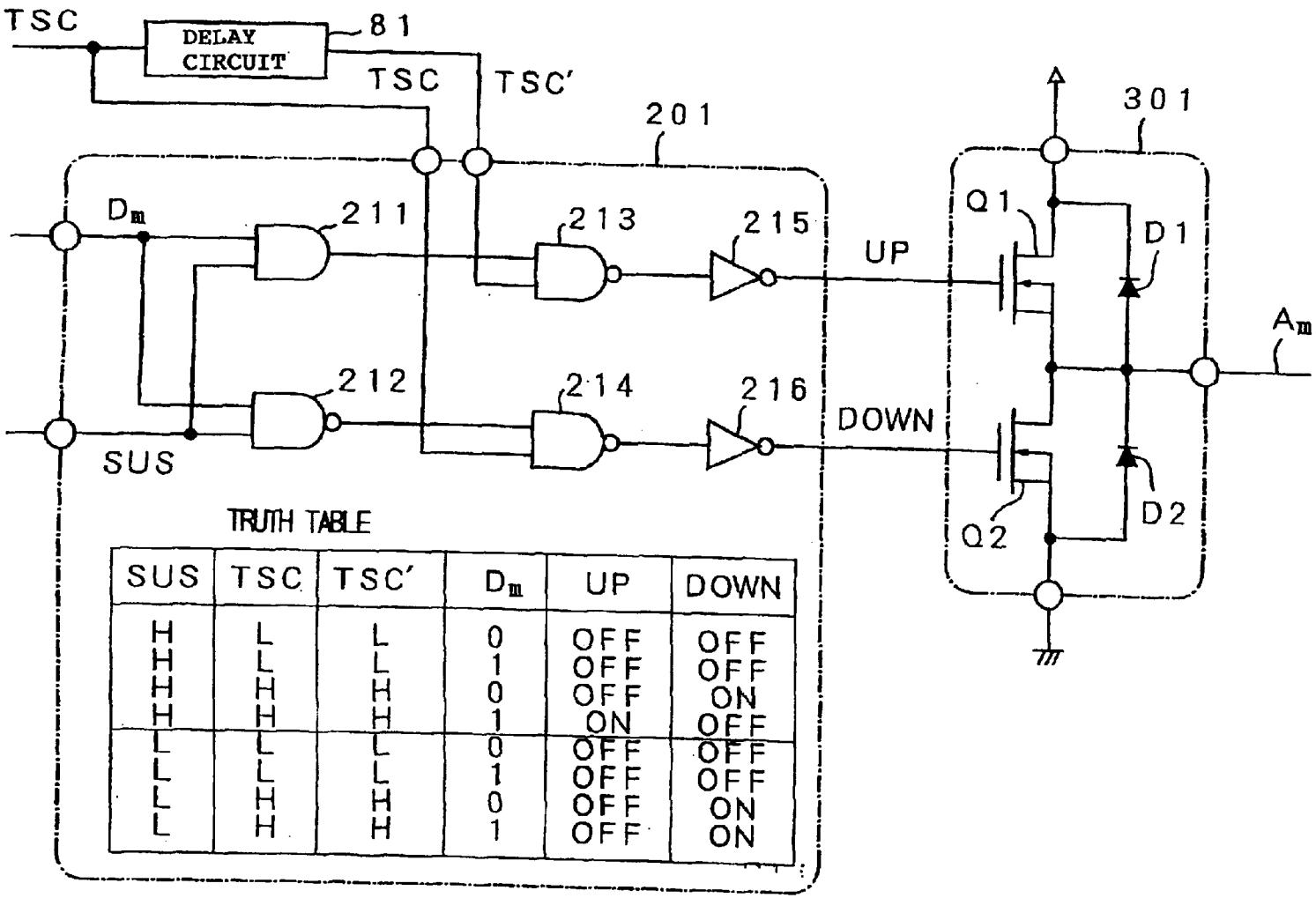
FIG. 5 is a schematic circuit diagram of the driver according to the first embodiment.

As shown in FIG. 5, the above-mentioned output control circuit 121 is a set of logic circuits 201, each of which is provided for each of the data electrodes $A_1$–$A_M$. In addition, the output circuit 131 is also a set of switching circuits 301, each of which is provided for each of the data electrodes $A_1$–$A_M$.

The logic circuit 201, which includes a plurality of gate circuits 211–216, outputs switching signals UP and DOWN having logical levels indicated by a truth table in FIG. 5. The switching circuit 301 comprises a pair of field effect transistors (hereinafter referred to as transistors) Q1 and Q2 connected serially as a switching element between the power source terminals, and protection diodes D1 and D2 connected between the source and the drain of the transistors Q1 and Q2 in the opposite direction. The transistor Q1 of the current supply terminal side of the power source is controlled by the switching signal UP, while the transistor Q2 of the current sink terminal side is controlled by the switching signal DOWN.

Figure 6:
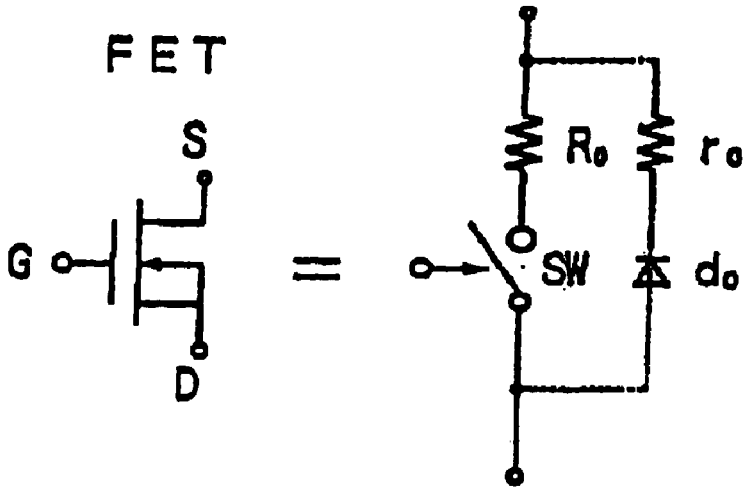
PRIOR ART FIG. 6
FIG. 6 is an equivalent circuit diagram of an FET.

As shown in FIG. 6, in the FET (field effect transistor), a backward current path, which includes a parasitic diode $d_0$ and a parasitic resister $r_0$, is formed in parallel with the closed circuit including the switch SW and an inner resister $R_0$. Therefore, even if the diodes D1 and D2 are omitted in the switching circuit 301, the parasitic diode $d_0$ can be used for realizing the L reset and the H reset. However, characteristics of the parasitic diode $d_0$ may vary and can be defective, so it is desirable to provide the diodes D1 and D2 adding to the parasitic diode $d_0$.

Figure 7:
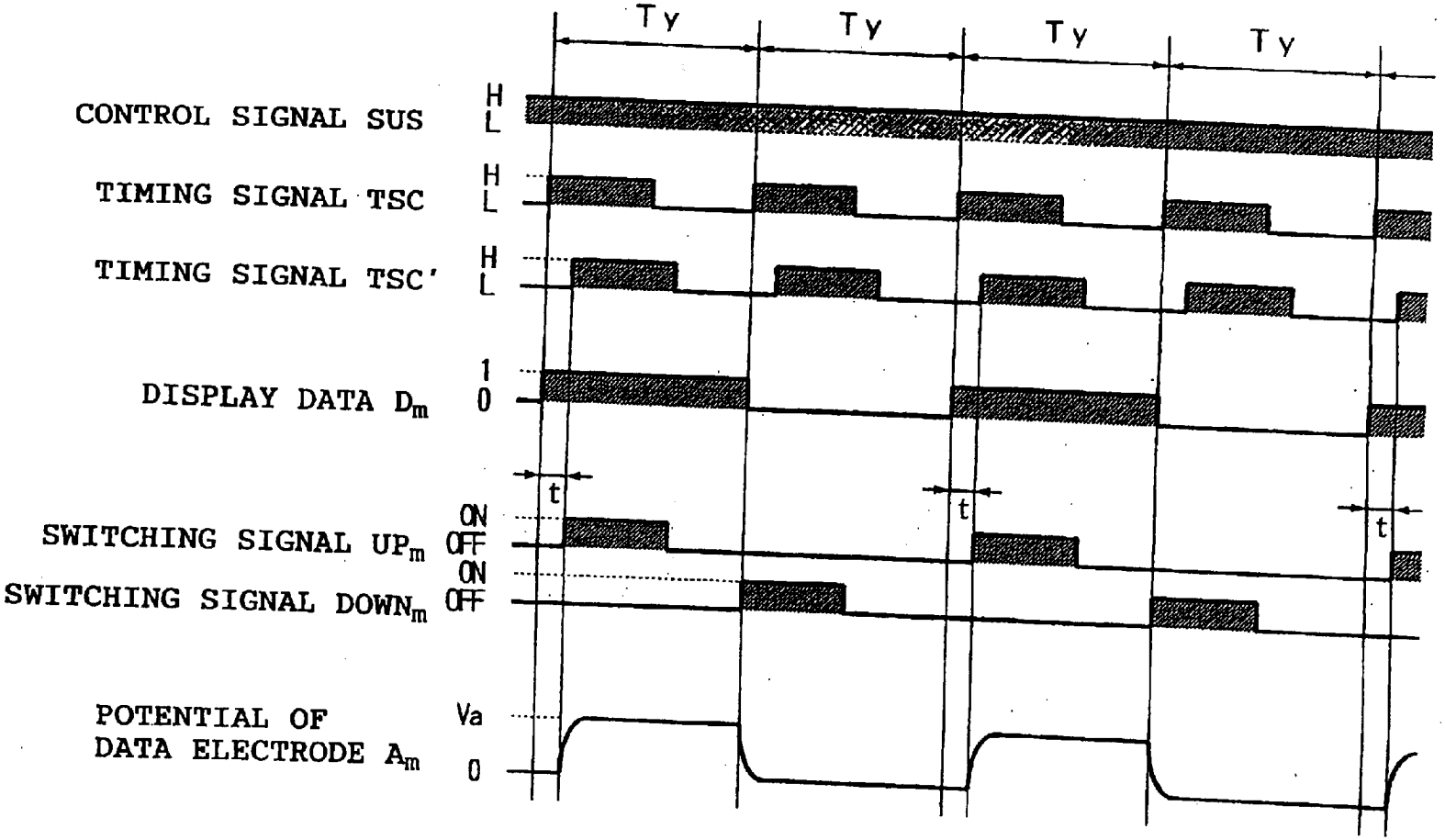
FIG. 7 is a time chart of data electrode control according to the first embodiment.
Figure 8:
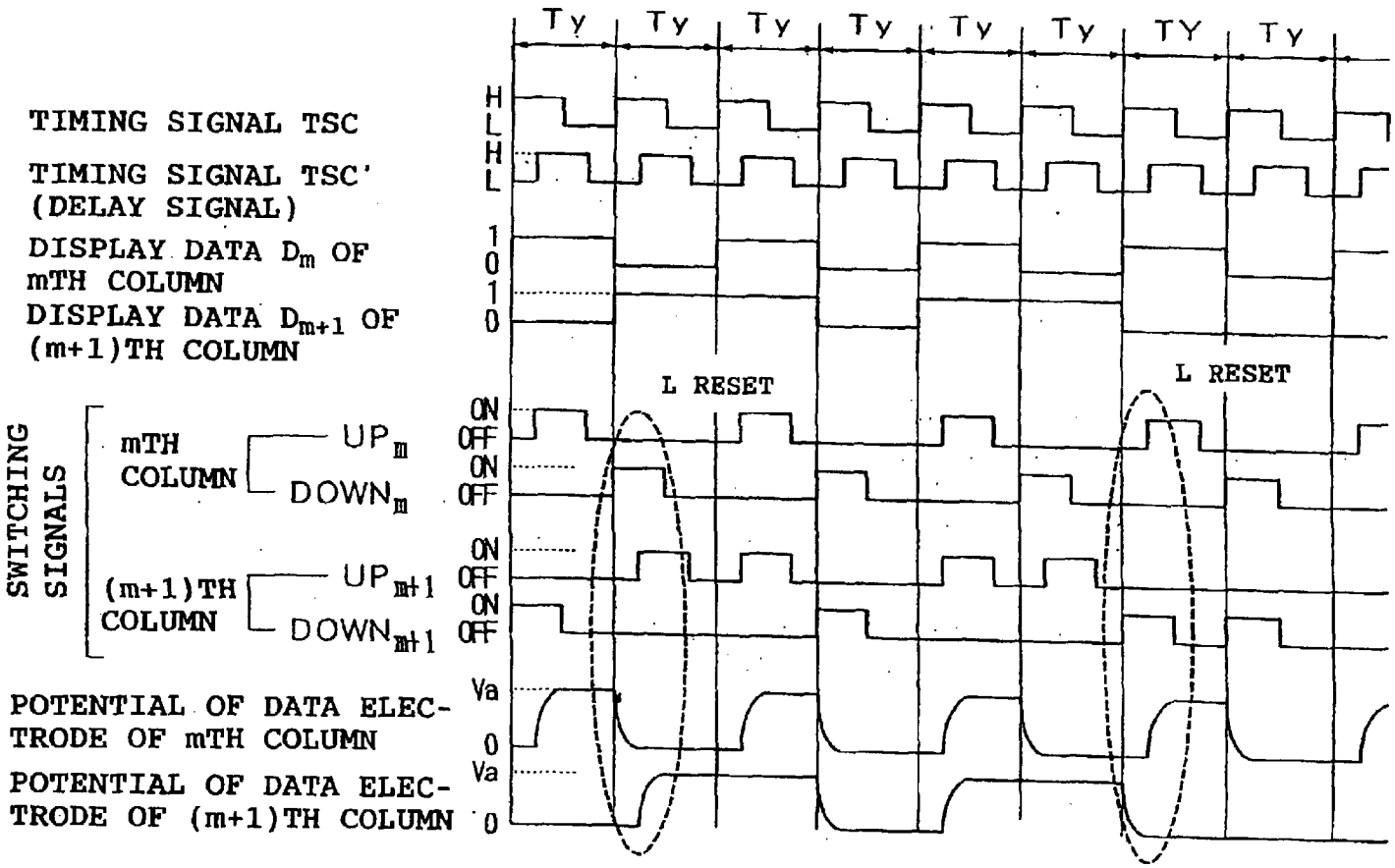
FIG. 8 is a time chart of the data electrode control according to the first embodiment.

As shown in FIG. 7, in a first embodiment, the timing signal TSC is delayed so that the on and off timings of the switching signal UP are shifted from that of the switching signal DOWN for the row selection period Ty. In other words, the switching signal DOWN corresponds to the timing signal TSC, while the switching signal UP corresponds to the timing signal TSC' that is delayed from the timing signal TSC by the time t. By this timing setting, only the switching signal DOWN is turned on at the boundary of the row selection and the L reset is realized in the case where the change of the display data $D_m$ and $D_{m+1}$ given to the neighboring data electrodes $A_m$ and $A_{m+1}$ are opposite to each other as shown in FIG. 8. The time t (the delay time of the delay circuit 81) is selected in accordance with the time constant of the discharge current path connecting the neighboring data electrodes to each other in the L reset, so as to be longer than the time necessary for discharging the charge stored in the capacitance between the neighboring data electrodes.

Figure 9A:
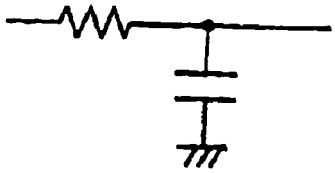
FIGS. 9A to 9D are diagrams each showing an example of a delay circuit.
Figure 9B:
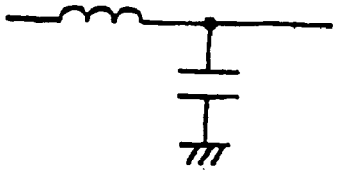
Figure 9C:
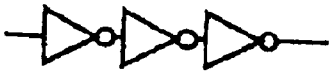
Figure 9D:
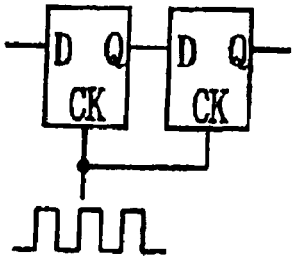

In the delay by an RC circuit shown in FIG. 9A and an LC circuit shown in FIG. 9B, the signal is delayed by the time constant determined by the circuit constant. It is possible to delay the signal by the time corresponding to the sum of the delay time of the buffer circuits that are connected in series. In the delay by the shift register, the delay time can be adjusted by setting the frequency of the clock given to a flip-flop.

Figure 10:
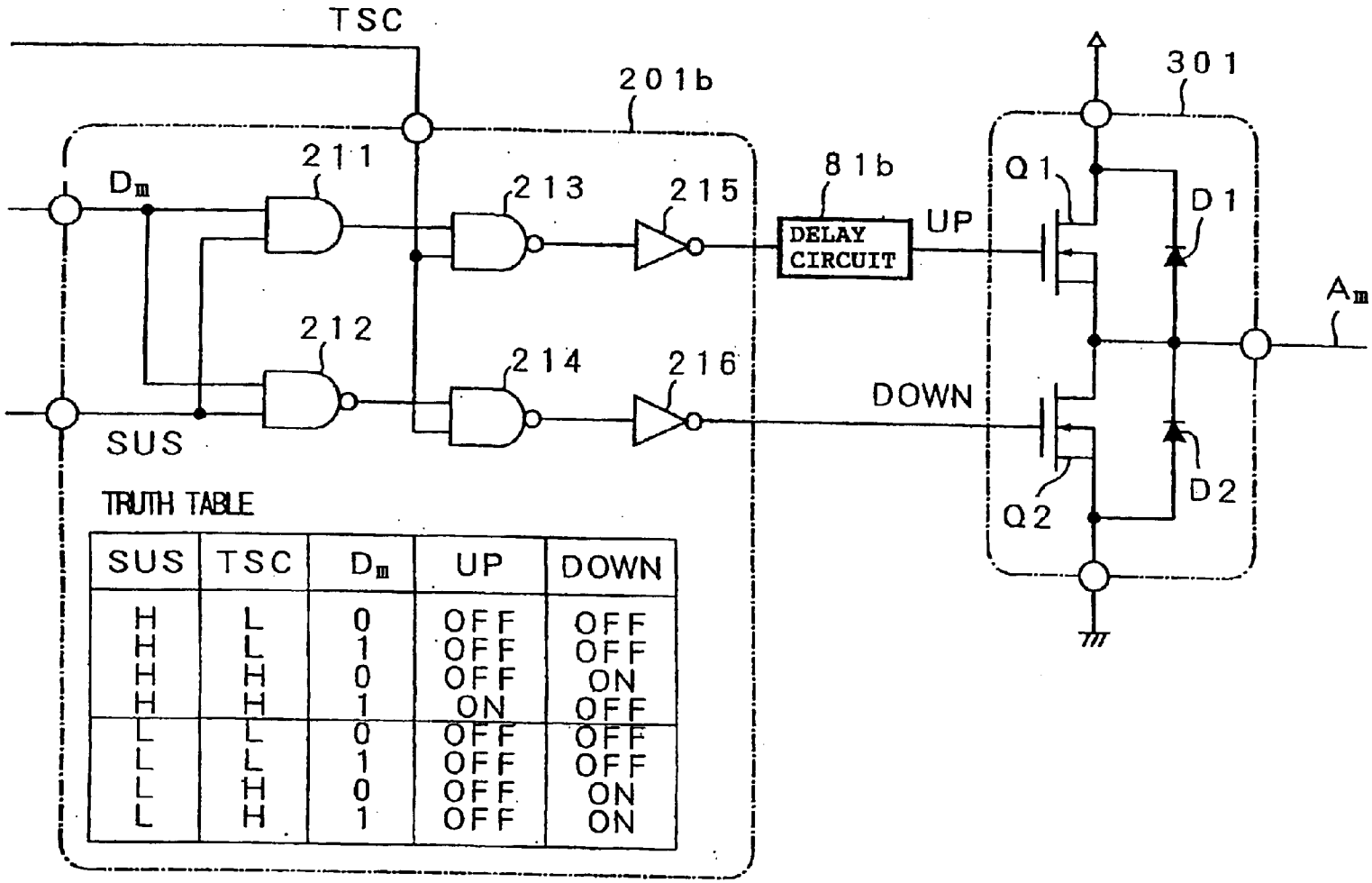
FIG. 10 is a schematic circuit diagram of the driver according to a variation of the first embodiment.

As shown in FIG. 10, the L reset can be also realized by providing a delay circuit 81*b* for each of the data electrodes $A_1$–$A_M$ instead of delaying the timing signal TSC. The switching signal DOWN is given directly to the transistor Q2 of the switching circuit 301 from the logic circuit 201*b* generating the signal corresponding to the combination of the timing signal TSC and the display data $D_m$, while the switching signal UP is given to the transistor Q1 via the delay circuit 81*b*.

Figure 11:
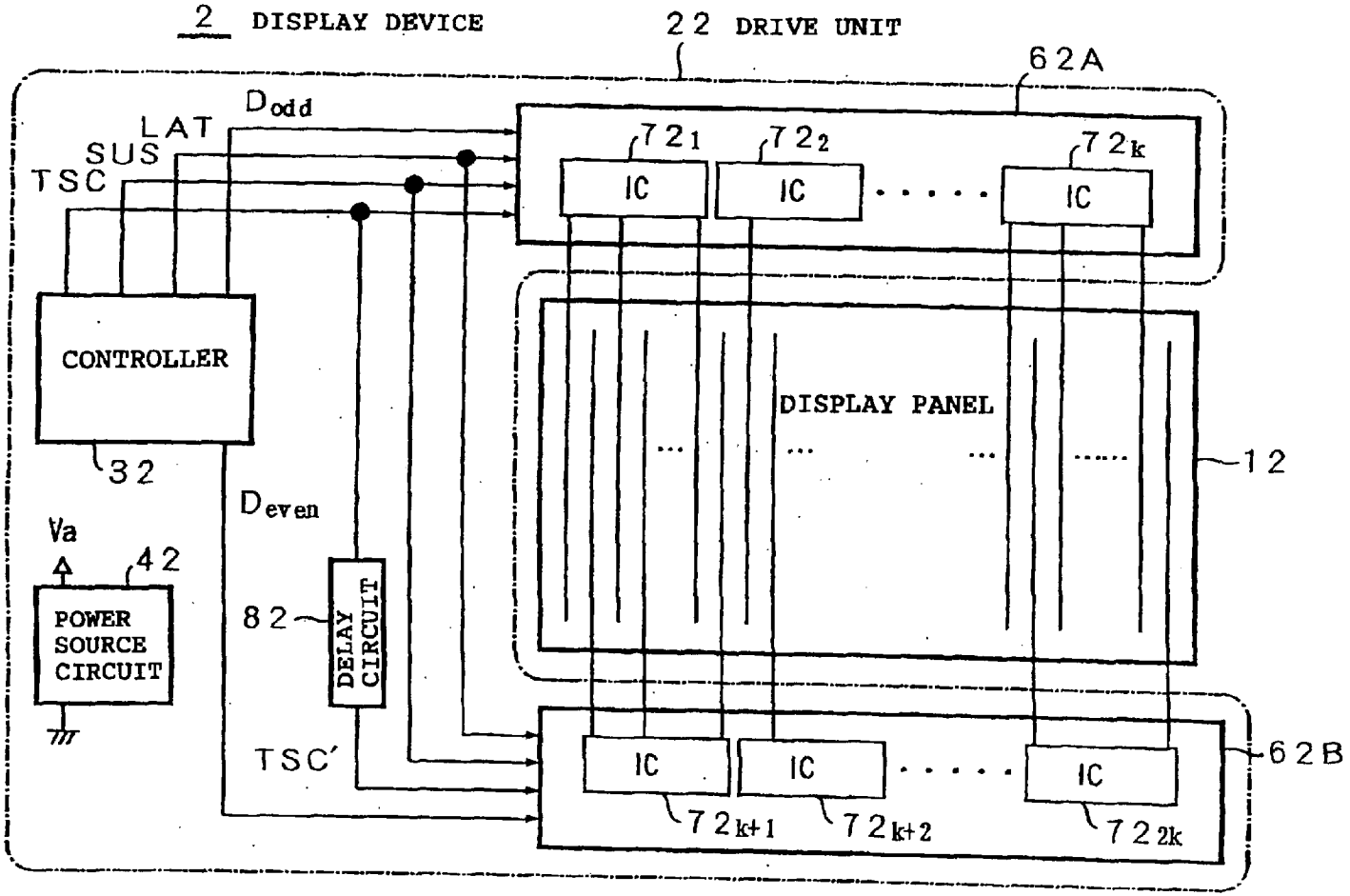
FIG. 11 is a block diagram of a main portion of a display device according to a second embodiment.

FIG. 11 shows only the elements related to the data electrode and control thereof.

In a second embodiment, the timing signal TSC is delayed so that the on and off timings of the switching signals UP and DOWN are different between an odd column and an even column.

The display device 2 comprises a display panel 12 and a drive unit 22. The drive unit 22 includes a controller 32, a power source circuit 42, a driver 62A for odd column data electrodes, a driver 62B for even column data electrodes and a delay circuit 82. The driver 62A comprises a plurality of integrated circuit chips $\mathbf{72}_1$–$\mathbf{72}_k$, while the driver 62B comprises a plurality of integrated circuit chips $\mathbf{72}_{k+1}$–$\mathbf{72}_{2k}$. The structure in which the drivers of the data electrode are disposed at both sides in the column direction is suitable for the case where the column pitch is small. The controller 32 transfers the display data $D_{odd}$ of odd columns to the driver 62A serially and transfers the display data $D_{even}$ of even columns to the driver 62B serially every row selection period Ty in the addressing. The control signals LAT and SUS are given to the drivers 62A and 62B commonly. The timing signal TSC is given only to the driver 62A, while the signal TSC', which is delayed from the timing signal TSC, is given to the driver 62B.

Figure 12:
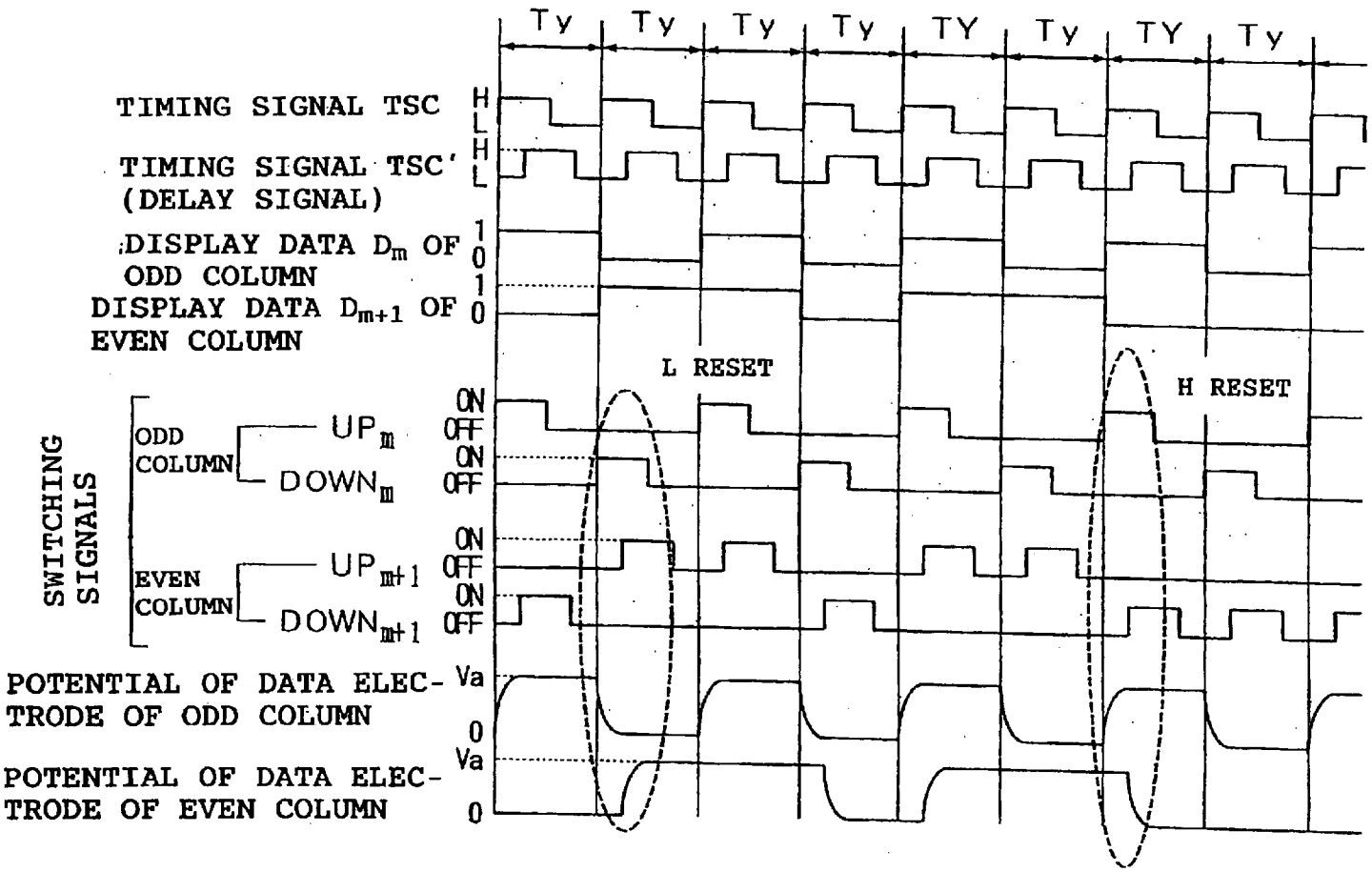
FIG. 12 is a time chart of the data electrode control according to the second embodiment.

By this circuit structure, the L reset in which only the switching signal DOWN is turned on at the boundary of the row selections or the H reset in which only the switching signal UP is turned on can be realized when the change of the display data $D_m$ and $D_{m+1}$ are opposite between the neighboring data electrodes $A_m$ and $A_{m+1}$ as shown in FIG. 12.

According to the first embodiment and the second embodiment mentioned above, the integrated circuit chips, which were used conventionally, can be used for constituting the driver. In addition, the delay time of the signal can be adjusted, so as to support various display panels having different capacitance between the data electrodes. Therefore, the drive unit can be used for various display panels.

Figure 13:
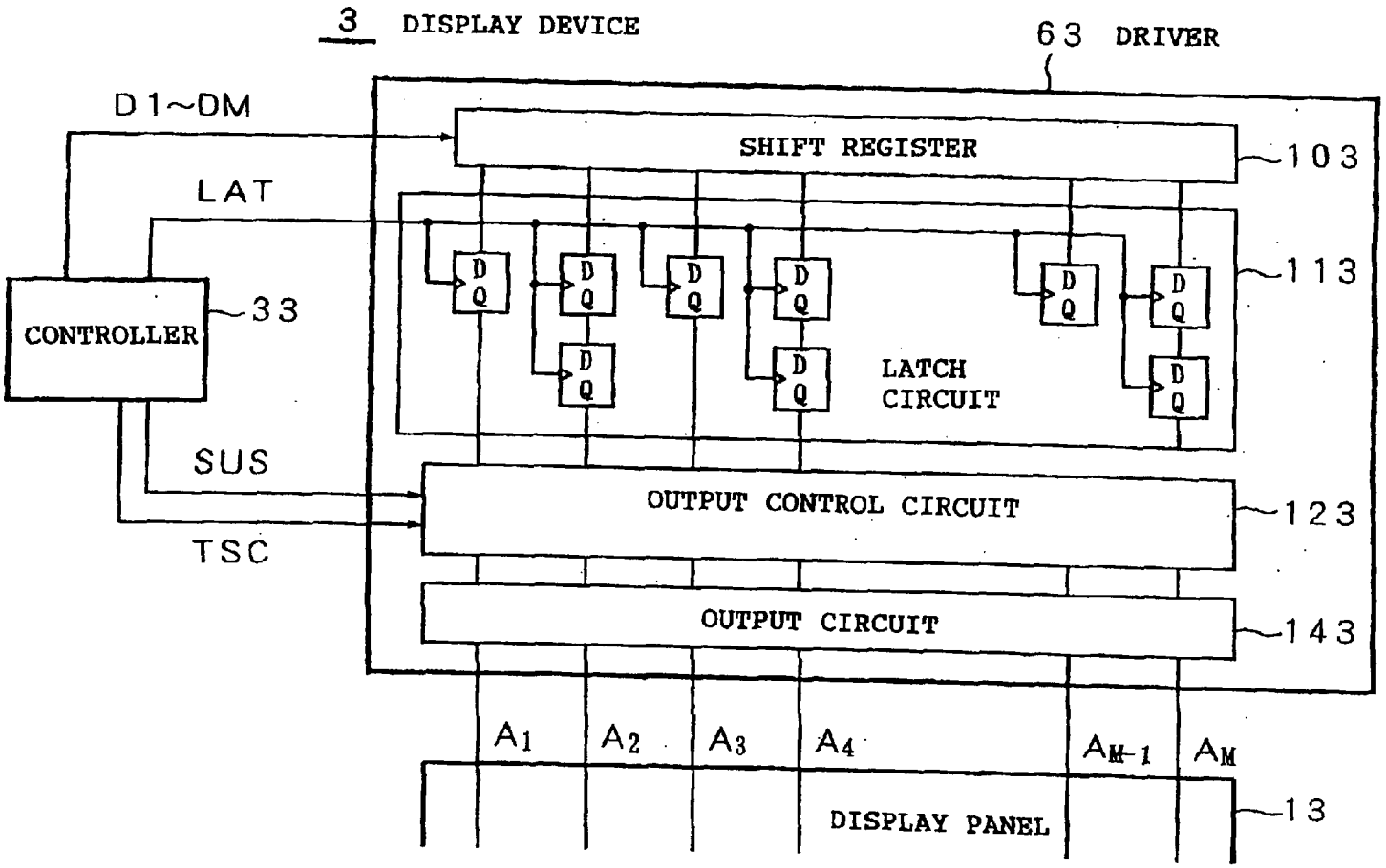
FIG. 13 is a block diagram of a main portion of a display device according to a third embodiment.

As shown in FIG. 13, in a third embodiment, display data of an even column are delayed from that of an odd column, so that the on and off timings of the switching signals UP and DOWN are different between the odd column and the even column.

The display device 3 includes a display panel 13, a controller 33 and a driver 63 being in charge of controlling all data electrodes $A_1$–$A_M$. The driver 63 comprises a shift register 103, a latch circuit 113, an output control circuit 123 and an output circuit 143. The output circuit 143 is a set of circuits that are similar to the switching circuit 301 shown in FIG. 10, while the output control circuit 123 is a set of circuits that are similar to the logic circuit 201*b* shown in FIG. 10. In the display device 3, the latch circuit 113 is structured to latch by one step for odd columns and by two steps for even columns. By this structure, the second step of latch is delayed, so that the on and off timings of the switching signals UP and DOWN are shifted for realizing the L reset and the H reset. Furthermore, it is possible to structure the on and off control of the delay can be performed, so that the switching control related to the L reset and the H reset is performed only for a specific display pattern.

Figure 14:
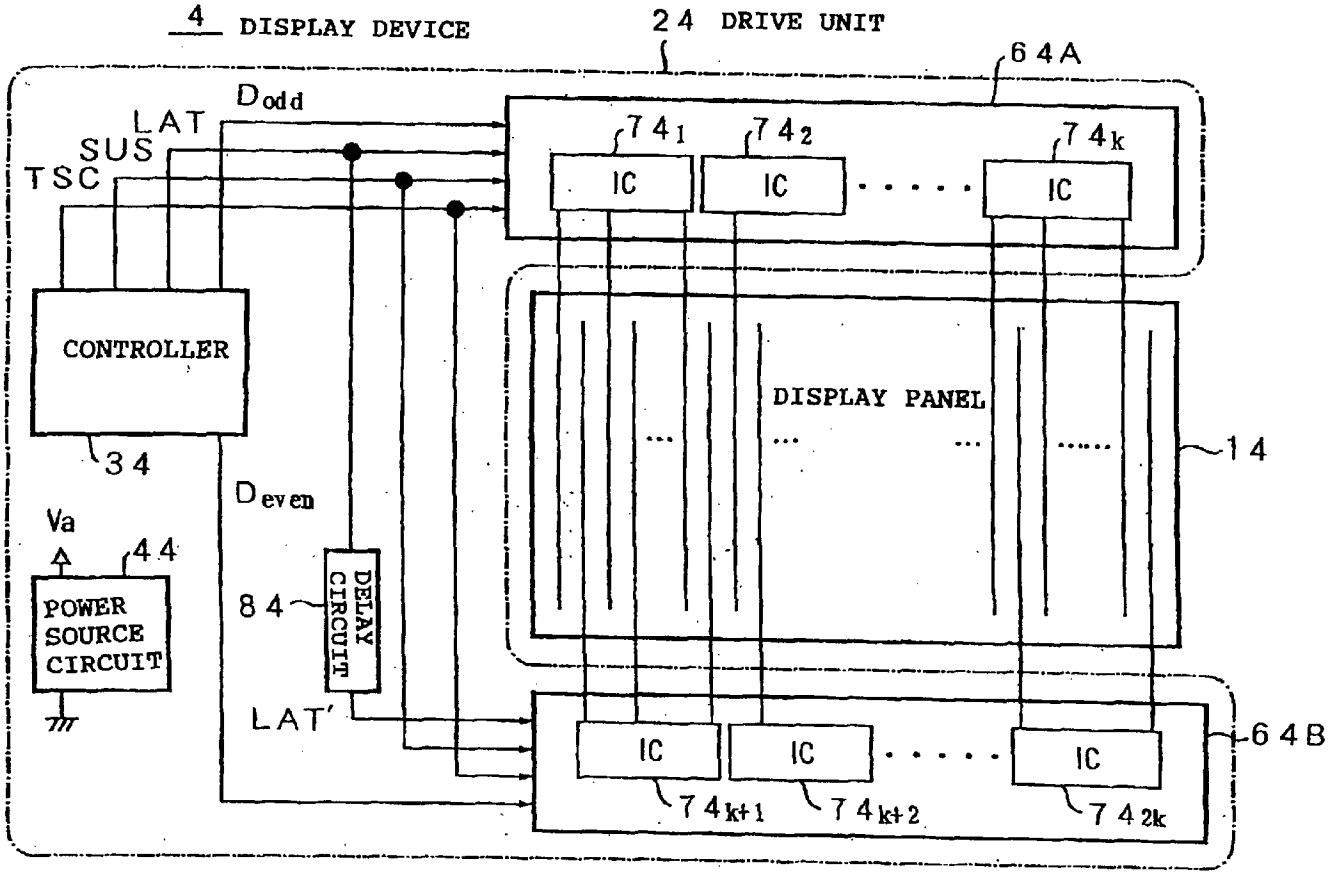
FIG. 14 is a block diagram of a main portion of a display device according to a fourth embodiment.

As shown in FIG. 14, in a fourth embodiment, the control signal LAT is delayed so that the on and off timings of the switching signals UP and DOWN are different between an odd column and an even column.

The display device 4 comprises a display panel 14 and a drive unit 24. The drive unit 24 includes a controller 34, a power source circuit 44, a driver 64A of data electrodes of odd columns, a driver 64B of data electrodes of even columns and a delay circuit 84. The driver 64A comprises a plurality of integrated circuit chips $\mathbf{74}_1$–$\mathbf{74}_k$, while the driver 64B comprises a plurality of integrated circuit chips $\mathbf{74}_{k+1}$–$\mathbf{74}_{2k}$. The controller 34 transfers display data $D_{odd}$ of odd columns to the driver 64A serially and transfers display data $D_{even}$ of even columns to the driver 64B serially every row selection period Ty in addressing. The control signals SUS and TSC to the drivers 64A and 64B commonly. The control signal LAT is given only to the driver 64A, while the signal TSC' that is delayed from the control signal LAT is given to the driver 64B.

Figure 15:
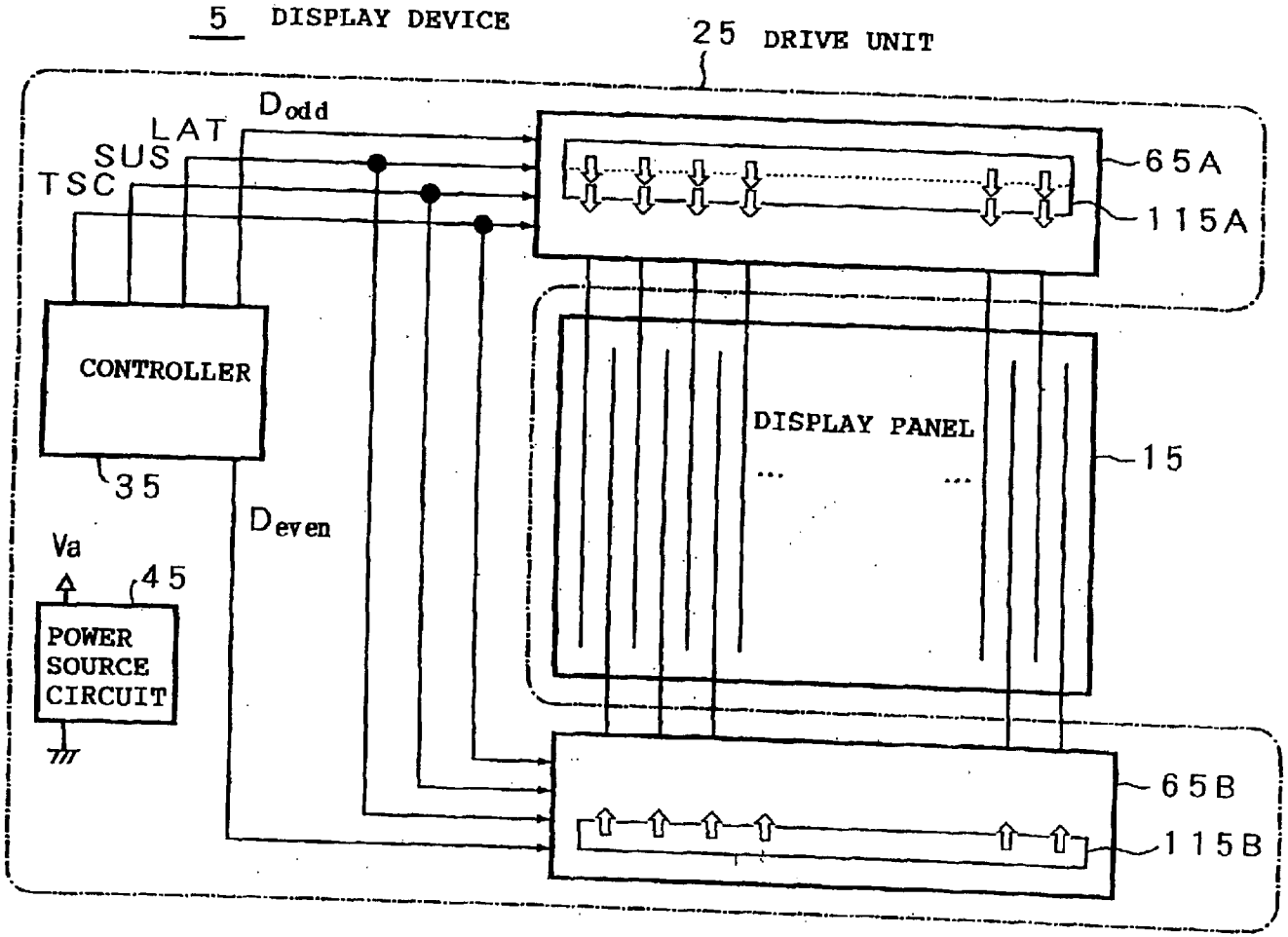
FIG. 15 is a block diagram of a main portion of a display device according to a fifth embodiment.
Figure 16:
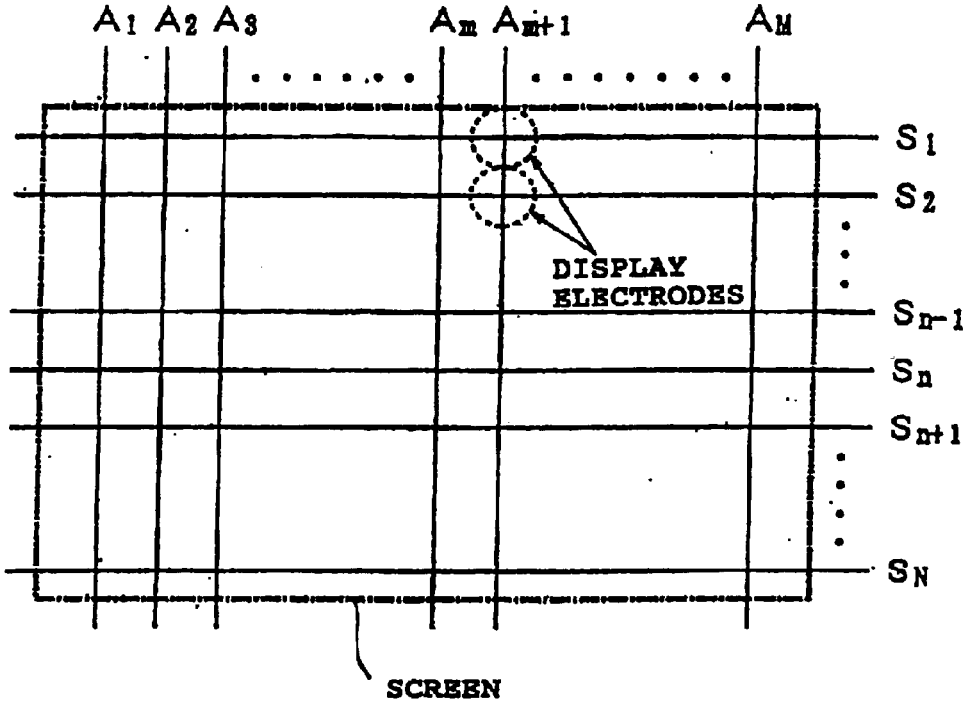
PRIOR ART FIG. 16
FIG. 16 is a schematic diagram of an electrode matrix.
Figure 17A:
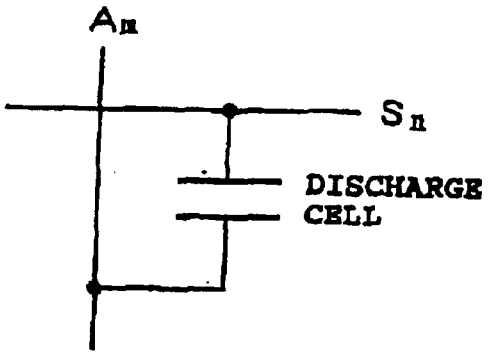
PRIOR ART FIG. 17A
FIGS. 17A to 17D are diagrams each showing an example of a display element.
Figure 17B:
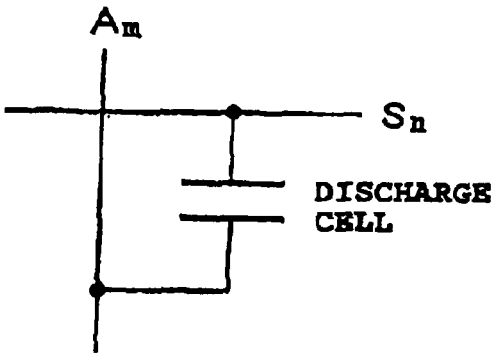
Figure 17C:
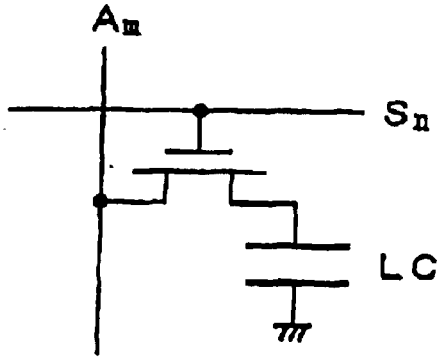
Figure 17D:
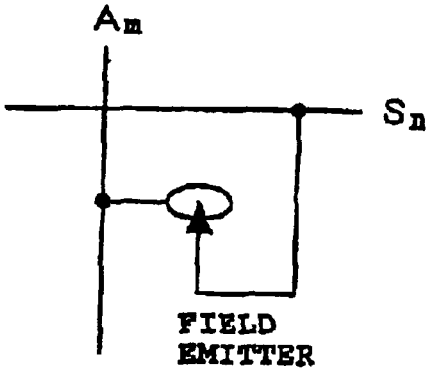
Figure 18:
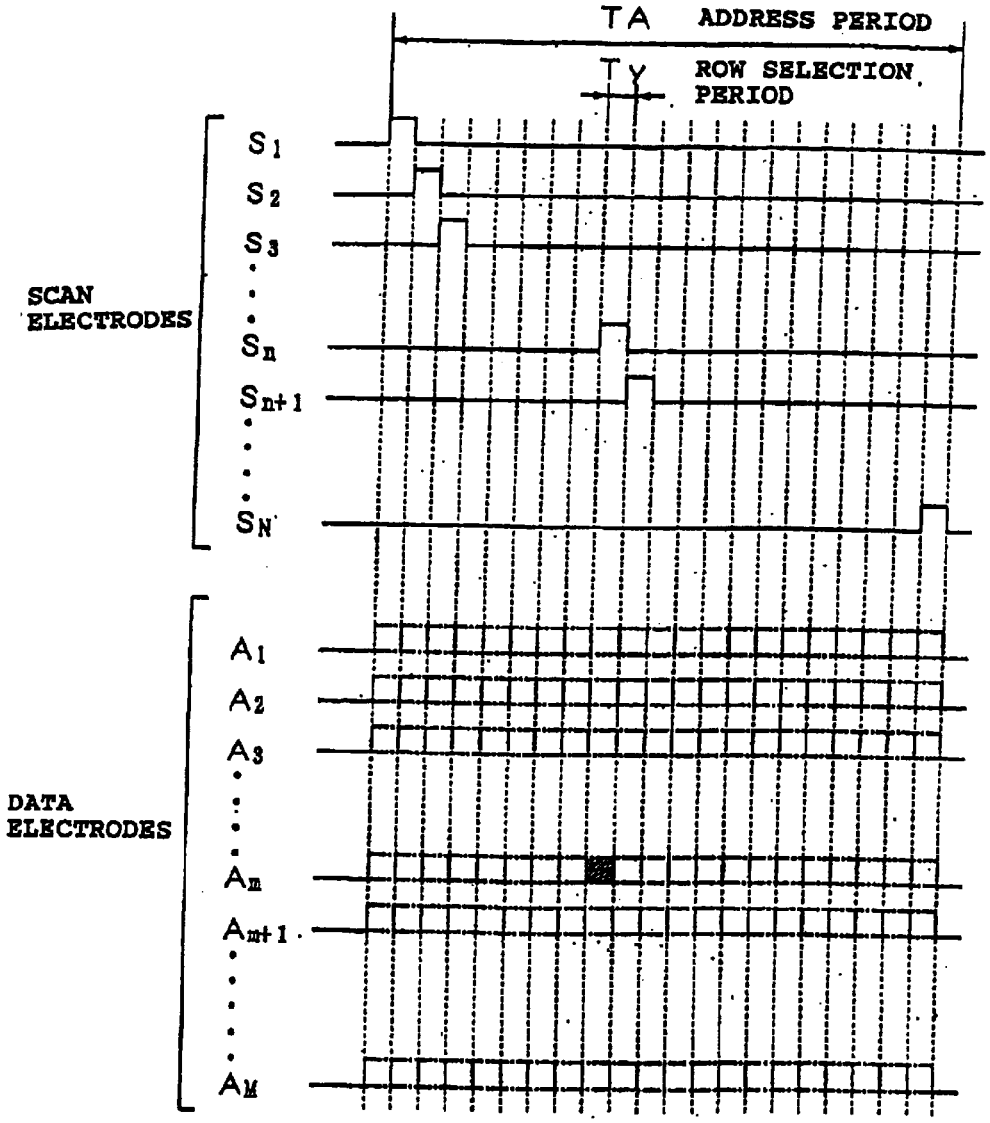
PRIOR ART FIG. 18
FIG. 18 is a time chart showing a scheme of line sequential addressing.
Figure 19:
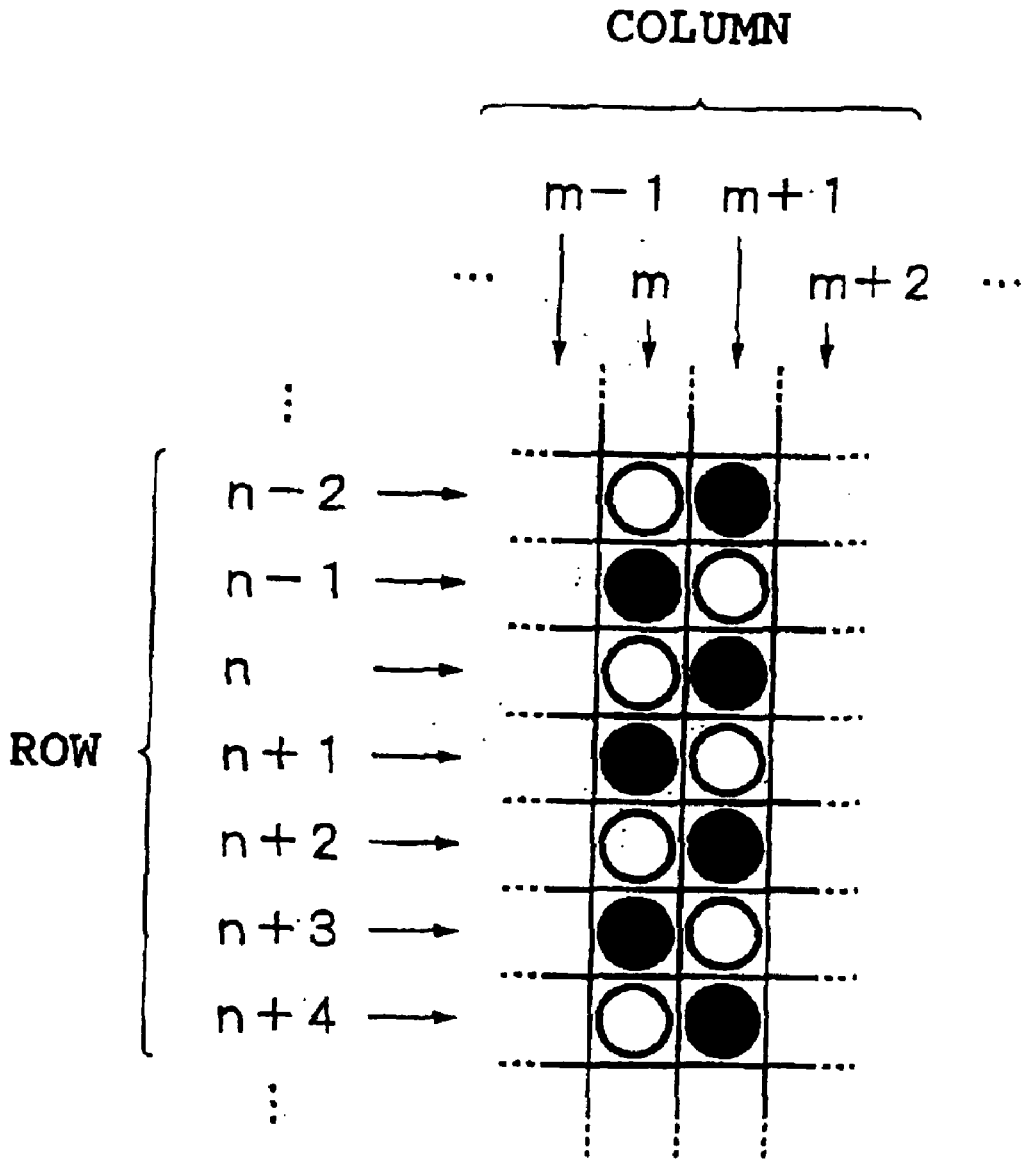
FIG. 19 is a diagram showing an example of a display pattern.
Figure 20:
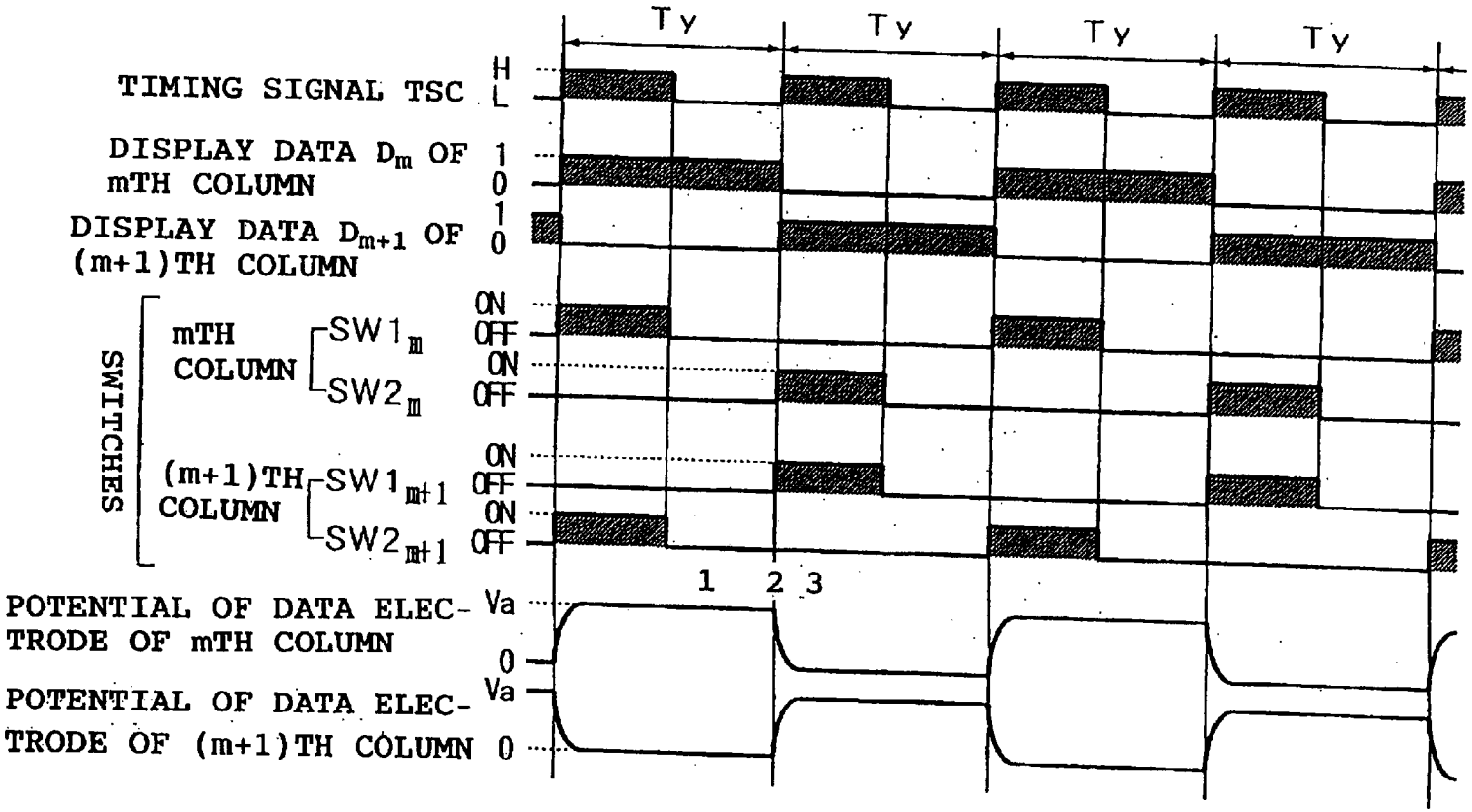
FIG. 20 Prior Art
FIG. 20 is a time chart of data electrode control in the conventional driving method.
Figure 21:
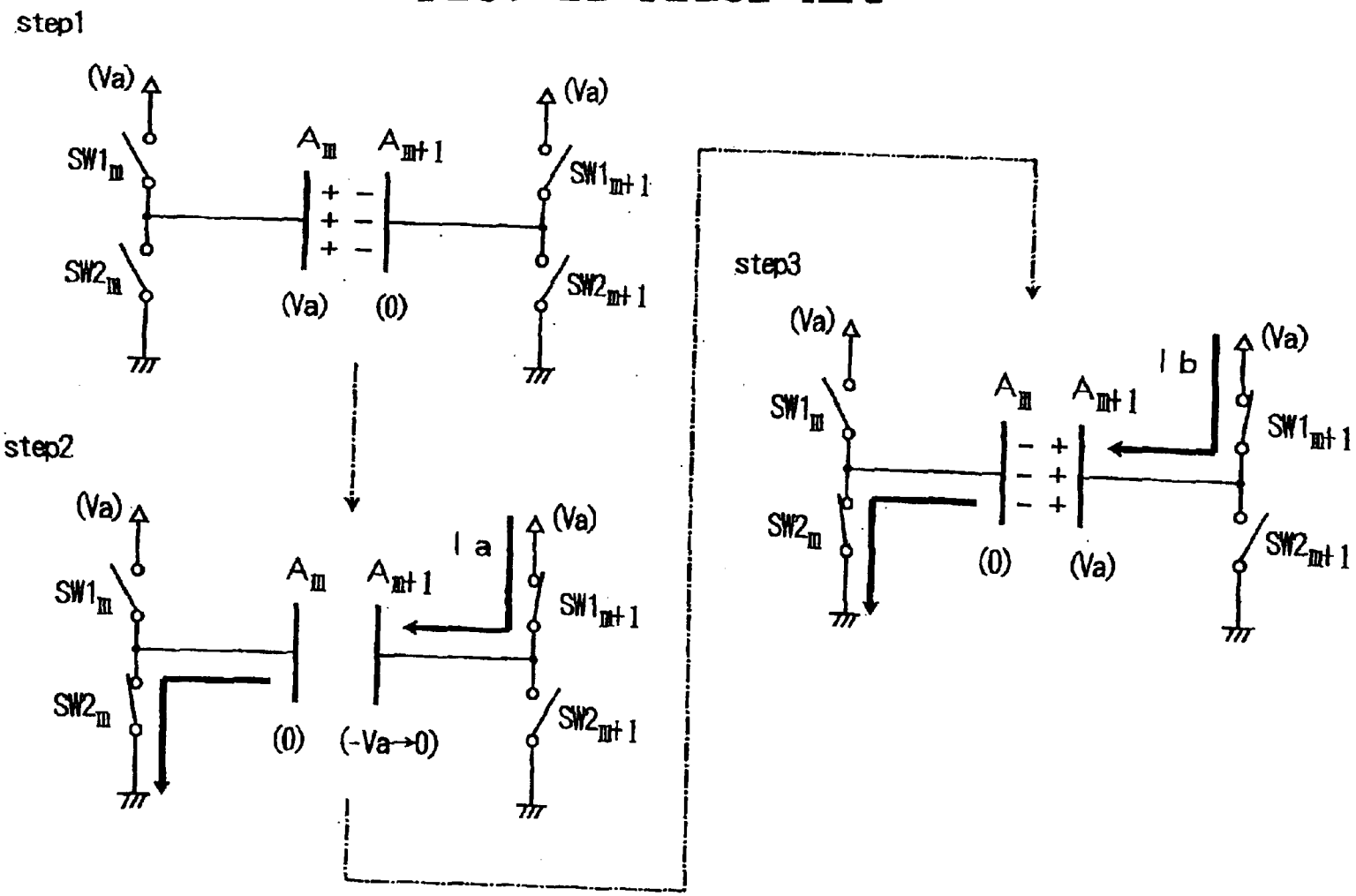
FIG. 21 Prior Art
FIG. 21 is a diagram showing a conventional problem.

As shown in FIG. 15, in a fifth embodiment, a driver having delay means is used for delaying display data of an odd column from display data of an even column, so that the on and off timings of the switching signals UP and DOWN are different between the odd column and the even column.

The display device 5 comprises a display panel 15 and a drive unit 25. The drive unit 25 includes a controller 35, a power source circuit 45, a driver 65A of data electrodes of odd columns and a driver 65B of data electrodes of even columns. The controller 35 transfers the display data $D_{odd}$ of the odd columns to the driver 65A serially and transfers the display data $D_{even}$ of the even columns to the driver 65B serially every row selection period Ty in the addressing. The control signals LAT, SUS and TSC are given to the drivers 65A and 65B commonly. The control signal LAT is given only to the driver 64A, while a signal TSC' delayed from the control signal LAT is given to the driver 64B.

The driver 65A includes a two-step latch circuit 115A for latching display data $D_{odd}$ of odd columns outputted by a shift register (not shown) in parallel. The driver 65B includes a one-step latch circuit 115B for latching display data $D_{even}$ of even columns outputted by a shift register (not shown) in parallel. Since the latch circuit 115A is different from the latch circuit 115B about the step number, the on and off timings of the switching signals UP and DOWN are different between the odd column and the even column. Each of the drivers 65A and 65B comprises a plurality of integrated circuit chips.

According to the fifth embodiment, an integrated circuit chip having delay function for constituting the driver 65A can be used as mixed with the conventional integrated circuit chip having no delay function for constituting the driver 65B, so that the stocked conventional components are also used for realizing the present invention without waste.

Industrial Availability

As explained above, undesired power consumption due to capacitance between data electrodes in a display panel can be reduced by applying the present invention.

We claim:

1. A driving method of a display panel having a plurality of scan electrodes arranged in the column direction and a plurality of data electrodes arranged in the row direction of a screen, comprising:

a line sequential addressing for controlling potential of the data electrode in synchronization with row selection by individual potential control of the scan electrode, wherein, when n-th display data as well as (n+1)th display data are different between the neighboring data electrodes and n-th display data are different from (n+1)th display data in each of the data electrodes, stored charge due to capacitance between the neighboring data electrodes is discharged by connecting one of the data electrodes to a power source line and by connecting the other data electrode to the power source line via a forward direction diode before switching the potential corresponding to the n-th display data to the potential corresponding to the (n+1)th display data.

2. A display device, comprising;

a display panel including a plurality of scan electrodes arranged in the column direction and a plurality of data electrodes arranged in the row direction of a screen and a driving circuit for controlling potential of the scan electrodes and the data electrodes in accordance with binary display data, the display device performing a line sequential addressing to control potential of the data electrode in binary manner in synchronization with row selection by the scan electrode, wherein each of the data electrodes is provided with means for controlling the potential in binary manner, which is a switching circuit of a push-pull structure including a pair of switching elements for connecting a current supply terminal of a driving power source with the data electrode and for connecting a current sink terminal of the driving power source with the data electrode and a backward current path including a diode, connected in parallel with an opening and closing path in each of the switching elements, and each of the data electrodes is further provided with a signal generating circuit that gives in the addressing a first switching signal to the switching element of the current sink side, the first switching signal corresponding to a combination of display data given at every switching of the row selection and a timing signal repeating on and off by a row selection period in synchronization with the row selection and gives in the addressing a second switching signal to the switching element of the current supply side, the second switching signal corresponding to a combination of the display data and a delayed signal of the timing signal.

3. The display device according to claim 2, wherein the delay time of the timing signal is longer than the time necessary for discharging the stored charge due to the capacitance between the neighboring data electrodes and is shorter than the row selection period.

4. A display device, comprising:

a display panel including a plurality of scan electrodes arranged in the column direction and a plurality of data electrodes arranged in the row direction of a screen and a driving circuit for controlling potential of the scan electrodes and the data electrodes in accordance with binary display data, the display device performing a line sequential addressing in which potential of the data electrode is controlled in binary manner in synchronization with row selection by the scan electrode, wherein each of the data electrodes is provided with means for controlling the potential in binary manner, which is a switching circuit of a push-pull structure including a pair of switching elements for connecting a current supply terminal of a driving power source with the data electrode and for connecting a current sink terminal of the driving power source with the data electrode and a backward current path including a diode, connected in parallel with an opening and closing path in each of the switching elements, and each of the data electrodes is further provided with a signal generating circuit and a signal delay circuit, the signal generating circuit giving in the addressing a first switching signal which corresponds to a combination of display data given at every switching of the row selection and a timing signal repeating on and off by a row selection period in synchronization with the row selection to the switching element of the current sink side, and the signal delay circuit giving in the addressing a second switching signal that is a delayed first switching signal to the switching element of the current supply side.

5. A display device, comprising:

a display panel including a plurality of scan electrodes arranged in the column direction and a plurality of data electrodes arranged in the row direction of a screen and a driving circuit for controlling potential of the scan electrodes and the data electrodes in accordance with binary display data, the display device performing a line sequential addressing for controlling potential of the data electrode in binary manner in synchronization with row selection by the scan electrode, wherein each of the data electrodes is provided with means for controlling the potential in binary manner, which is a switching circuit of a push-pull structure including a pair of switching elements for connecting a current supply terminal of a driving power source with the data electrode and for connecting a current sink terminal of the driving power source with the data electrode and a backward current path including a diode, connected in parallel with an opening and closing path in each of the switching elements, and the on and off timings of the switching element corresponding to an odd data electrode in an arrangement are different from the on and off timings of the switching element corresponding to an even data electrode, in the addressing.

6. The display device according to claim 4, wherein a first and a second switching signals are generated, the first switching signal corresponding to a combination of display data given at every switching of the row selection and a timing signal repeating on and off by a row selection period in synchronization with the row selection, the second switching signal corresponding to a combination of the display data and a delayed signal of the timing signal, and one of the first and the second switching signal is used for controlling the switching element corresponding to the odd data electrode, while the other is used for controlling the switching element corresponding to the even data electrode.

7. The display device according to claim 6, wherein the delay time of the timing signal is longer than the time necessary for discharging the stored charge due to the capacitance between the neighboring data electrodes and is shorter than the row selection period.

8. The display device according to claim 6, comprising an integrated circuit device for generating the first switching signal and an integrated circuit device for generating the second switching signal which includes a circuit for delaying the timing signal.

9. The display device according to claim 5, wherein a first and a second switching signals are generated, the first switching signal corresponding to a combination of display data given at every switching of the row selection and a timing signal repeating on and off by a row selection period in synchronization with the row selection, the second switching signal corresponding to a combination of delayed data of the display data and the timing signal, and one of the first and the second switching signal is used for controlling the switching element corresponding to the odd data electrode, while the other is used for controlling the switching element corresponding to the even data electrode.

10. The display device according to claim 9, wherein the delay time of the display data is longer than the time necessary for discharging the stored charge due to the capacitance between the neighboring data electrodes and is shorter than the row selection period.

11. The display device according to claim 9, comprising a first integrated circuit device for generating the first switching signal and a second integrated circuit device for generating a second switching signal which includes a circuit for delaying the display data.

12. The display device according to claim 2, wherein the switching element is a field effect transistor, and the diode is a parasitic diode unique to the field effect transistor for forming a switching path connected in parallel with the field effect transistor.

13. The display device according to claim 4, wherein the switching element is a field effect transistor, and the diode is a parasitic diode unique to the field effect transistor for forming a switching path connected in parallel with the field effect transistor.

14. The display device according to claim 5, wherein the switching element is a field effect transistor, and the diode is a parasitic diode unique to the field effect transistor for forming a switching path connected in parallel with the field effect transistor.

15. The display device according to claim 2, wherein the diode is another circuit element separated from the switching element.

16. The display device according to claim 4, wherein the diode is another circuit element separated from the switching element.

17. The display device according to claim 5, wherein the diode is another circuit element separated from the switching element.

18. An integrated circuit device for controlling potential of a plurality of data electrodes arranged in the row direction of a screen of a display panel in accordance with binary display data, comprising:

a plurality of switching circuits, each of which corresponds to each of the data electrodes, wherein each of the switching circuits includes a pair of switching elements for connecting a current supply terminal of a driving power source with a data electrode and for connecting a current sink terminal of a driving power source with the data electrode, the switching circuit being a push-pull circuit in which a backward current path including a diode is connected in parallel with a switching path in each of the switching elements; and a signal delay circuit delaying on and off timings of the switching element of the current supply side from the on and off timings of the switching element of the current sink side.

19. An integrated circuit device for controlling potential of a target electrode that is an odd or an even data electrode among data electrodes arranged in the row direction of a screen of a display panel in accordance with binary display data, comprising:

a delay circuit for delaying display data that are inputted in synchronization with row selection of line sequential addressing;

a logic circuit for generating a switching signal corresponding to a combination of display data from the delay circuit and a timing signal repeating on and off by a row selection period; and a group of switching circuits, each of which is provided for each of the target electrodes; wherein each of the switching circuits includes a pair of switching elements for connecting a current supply terminal of a driving power source with a data electrode and for connecting a current sink terminal of the driving power source with the data electrode, the switching circuit being a push-pull circuit in which a backward current path including a diode is connected in parallel with a switching path in each of the switching elements; and the switching element is controlled by the switching signal.

* * * * *

UNITED STATES PATENT AND TRADEMARK OFFICE

CERTIFICATE OF CORRECTION

PATENT NO. : 6,906,706 B2
DATED : June 14, 2005
INVENTOR(S) : Tadayoshi Kosaka et al.

It is certified that error appears in the above-identified patent and that said Letters Patent is hereby corrected as shown below:

Column 9,
Line 30, change “comprising;” to -- comprising: --.

Signed and Sealed this

Fourteenth Day of March, 2006

JON W. DUDAS
*Director of the United States Patent and Trademark Office*